US007892032B2

(12) United States Patent
Pizzi

(10) Patent No.: US 7,892,032 B2
(45) Date of Patent: Feb. 22, 2011

(54) TERMINAL BLOCK WITH JAW PART FOR ENGAGEMENT WITH THE FLAT PIN OF MOVABLE ELECTRIC CONTACTS

(75) Inventor: Giordano Pizzi, Milan (IT)

(73) Assignee: Morsettitalia S.p.A., Milan (IT)

( * ) Notice: Subject to any disclaimer, the term of this patent is extended or adjusted under 35 U.S.C. 154(b) by 0 days.

(21) Appl. No.: 12/026,386

(22) Filed: Feb. 5, 2008

(65) Prior Publication Data

US 2008/0248698 A1 Oct. 9, 2008

(30) Foreign Application Priority Data

Feb. 5, 2007 (IT) ..... MI2007A0187
Jul. 12, 2007 (IT) ..... MI2007A1390
Oct. 31, 2007 (IT) ..... MI2007A2104

(51) Int. Cl.
*H01R 13/68* (2011.01)

(52) U.S. Cl. ..... 439/620.33

(58) Field of Classification Search ..... 439/620.33, 439/811, 812, 828; 337/194, 213, 215
See application file for complete search history.

(56) References Cited

U.S. PATENT DOCUMENTS 945,017 A * 1/1910 Oole ..... 337/9
2,045,847 A 6/1936 Fotsch
2,082,947 A 6/1937 Fotsch
2,900,618 A 8/1959 Geier
3,159,730 A 12/1964 Staffel
3,609,642 A 9/1971 Norden
3,665,376 A 5/1972 Paris et al.
3,751,579 A 8/1973 Nojiri
3,775,733 A 11/1973 Ege
3,840,781 A 10/1974 Brown
4,070,086 A 1/1978 Trafford
4,130,331 A 12/1978 Neff et al.
4,171,861 A 10/1979 Hohorst
4,203,200 A 5/1980 Wiebe
4,224,592 A 9/1980 Urani et al.
4,241,975 A 12/1980 Cooper, Jr.
4,330,164 A 5/1982 Pittman et al.
4,340,270 A 7/1982 Wilmes et al.

(Continued)

FOREIGN PATENT DOCUMENTS

DE 1842868 U 12/1961

(Continued)

OTHER PUBLICATIONS

European Search Report from EP08075059, dated, Aug. 24, 2009.

*Primary Examiner*—Phuong K Dinh
(74) *Attorney, Agent, or Firm*—Mintz, Levin, Cohn, Ferris, Glovsky and Popeo, P.C.

(57) ABSTRACT

A terminal block for connecting electric wires using a removable contact, such as a fuse, with flat pins, includes an insulating body and two conducting elements housed inside the body. Associated with respective terminals for retaining the free end of a respective electric wire, the conducting elements including, at an end opposite to the end for retaining the wire, a resilient clamp which is open on one side for insertion, retention and electric contact with the respective flat pin of the movable contact.

23 Claims, 3 Drawing Sheets

U.S. PATENT DOCUMENTS

| | | | | |
|---|---|---|---|---|
| 4,350,407 | A | 9/1982 | Tong | |
| 4,365,396 | A | 12/1982 | Baba et al. | |
| 4,391,485 | A * | 7/1983 | Urani | 439/687 |
| 4,444,455 | A | 4/1984 | Wiancko et al. | |
| 4,559,504 | A | 12/1985 | Krec | |
| 4,693,533 | A | 9/1987 | Szczesny et al. | |
| 4,795,997 | A | 1/1989 | Fisher et al. | |
| 4,889,504 | A | 12/1989 | Barbier et al. | |
| 4,921,450 | A * | 5/1990 | Herbert | 439/620.26 |
| 4,940,431 | A | 7/1990 | Hennemann | |
| 5,002,505 | A | 3/1991 | Jones et al. | |
| 5,030,131 | A | 7/1991 | Boehm | |
| 5,243,139 | A | 9/1993 | Law | |
| 5,276,280 | A | 1/1994 | Ball | |
| 5,328,392 | A * | 7/1994 | Lin et al. | 439/833 |
| 5,454,730 | A | 10/1995 | Tozuka | |
| 5,553,787 | A | 9/1996 | Guginsky | |
| 5,564,941 | A | 10/1996 | Norden | |
| 5,766,044 | A | 6/1998 | Norden | |
| 5,853,304 | A | 12/1998 | Landreau et al. | |
| 5,860,837 | A | 1/1999 | Bock et al. | |
| 5,905,230 | A | 5/1999 | Marik | |
| 5,915,998 | A | 6/1999 | Stidham et al. | |
| 6,004,167 | A | 12/1999 | Hirakawa | |
| 6,157,287 | A | 12/2000 | Douglass et al. | |
| 6,475,038 | B1 | 11/2002 | Franck | |
| 6,786,779 | B2 | 9/2004 | Feldmeier et al. | |
| 7,101,231 | B2 | 9/2006 | Prokup et al. | |
| 7,385,518 | B2 * | 6/2008 | Torrez et al. | 340/638 |
| 7,413,486 | B2 | 8/2008 | Pizzi | |
| 7,438,606 | B2 | 10/2008 | Pizzi | |
| 7,500,889 | B2 | 3/2009 | Pizzi | |
| 2002/0067279 | A1 | 6/2002 | Torrez et al. | |
| 2005/0042912 | A1 | 2/2005 | Drewes et al. | |
| 2005/0221665 | A1 | 10/2005 | Otto et al. | |
| 2006/0128232 | A1 | 6/2006 | Kim | |
| 2006/0148302 | A1 | 7/2006 | Patel et al. | |
| 2006/0189222 | A1 | 8/2006 | Bogiel et al. | |
| 2006/0228950 | A1 | 10/2006 | Jamaleddin et al. | |
| 2007/0159292 | A1 | 7/2007 | Chang et al. | |
| 2008/0242150 | A1 | 10/2008 | Chikamatsu et al. | |

FOREIGN PATENT DOCUMENTS

| | | | |
|---|---|---|---|
| DE | 3339365 | A1 | 5/1985 |
| DE | 3621071 | A1 | 1/1987 |
| DE | 3629796 | C1 | 12/1987 |
| DE | 3805158 | A1 | 8/1989 |
| DE | 4223540 | A1 | 1/1994 |
| DE | 4231244 | A1 | 3/1994 |
| DE | 4409612 | A1 | 9/1994 |
| DE | 19530947 | A1 | 1/1997 |
| DE | 19542628 | C1 | 2/1997 |
| DE | 19729327 | C1 | 10/1998 |
| DE | 29821558 | U1 | 3/1999 |
| DE | 29921080 | | 4/2001 |
| DE | 10010719 | C1 | 8/2001 |
| DE | 10324144 | A1 | 2/2005 |
| DE | 102004018553 | A1 | 11/2005 |
| DE | 202005005369 | U1 | 3/2006 |
| EP | 0382999 | | 8/1990 |
| EP | 0678934 | A1 | 10/1995 |
| EP | 0893859 | A2 | 1/1999 |
| EP | 1137034 | A1 | 9/2001 |
| EP | 1137035 | A1 | 9/2001 |
| EP | 1381068 | A1 | 1/2004 |
| EP | 1531522 | A1 | 5/2005 |
| EP | 1536519 | A1 | 6/2005 |
| EP | 1630903 | A1 | 3/2006 |
| EP | 1798821 | A2 | 6/2007 |
| EP | 1860738 | A1 | 11/2007 |
| EP | 1887658 | A2 | 2/2008 |
| FR | 2259462 | A1 | 8/1975 |
| FR | 2529024 | A1 | 12/1983 |
| FR | 2637740 | A1 | 4/1990 |
| FR | 2766628 | A1 | 1/1999 |
| GB | 2342508 | A | 4/2000 |

* cited by examiner

Fig.4a
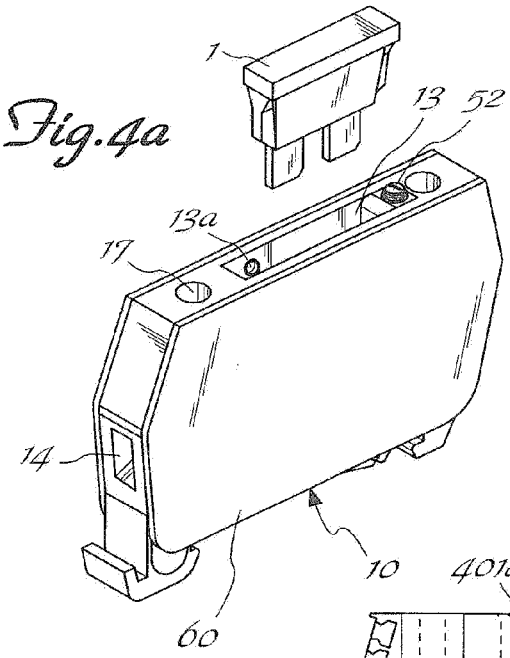
Fig.4b
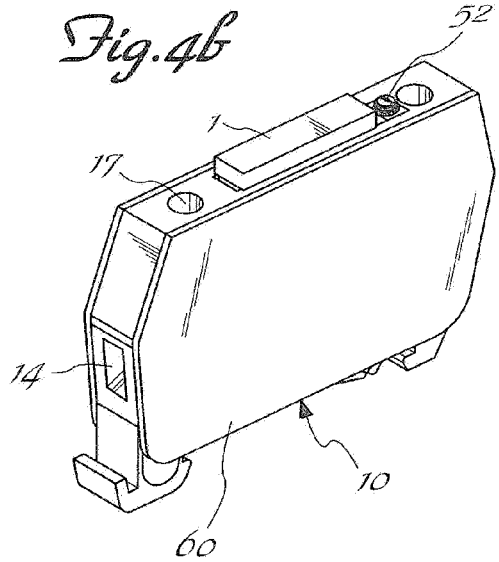
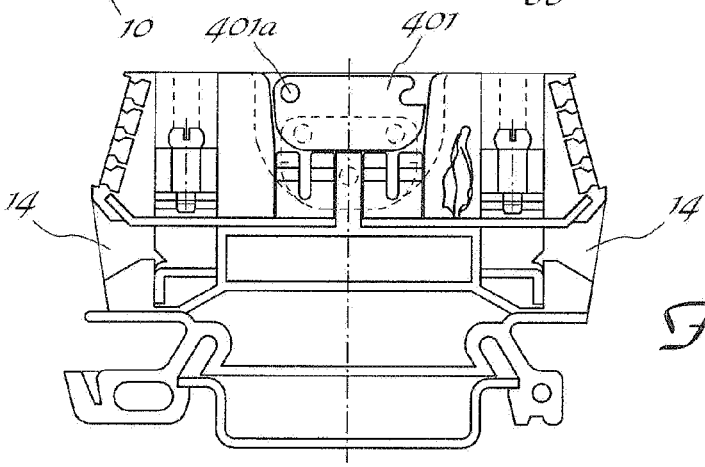
Fig.5
Fig.6a
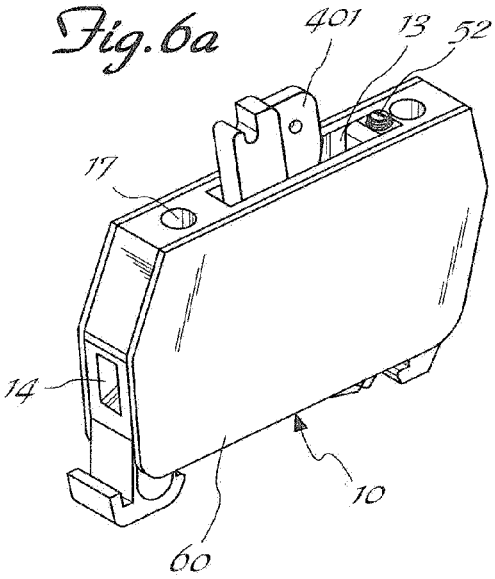
Fig.6b
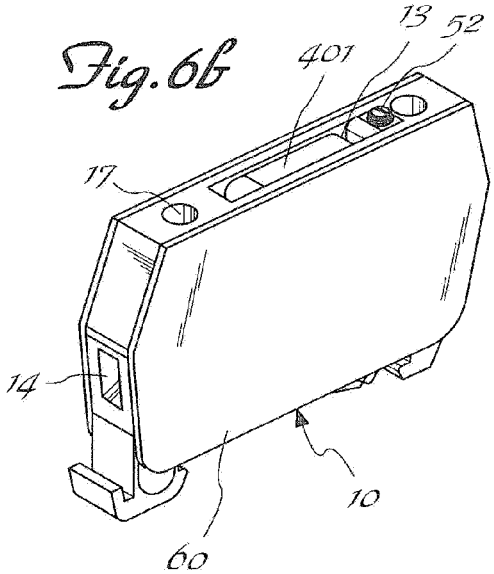

TERMINAL BLOCK WITH JAW PART FOR ENGAGEMENT WITH THE FLAT PIN OF MOVABLE ELECTRIC CONTACTS

TECHNICAL FIELD OF THE INVENTION

The present invention relates to a fuse-holder terminal block for connecting electric wires.

DESCRIPTION OF THE PRIOR ART

It is known in the technical sector relating to the design of distribution boards for the cables of electrical installations to use terminal blocks which can be mounted on associated supports and to provide at the front, access to the terminals—normally of the screw or spring type—for retaining the electric wires to be connected in order to restore the continuity of the electric circuit section; it is also known that this continuity is achieved by inserting in a special seat which can be accessed frontally, movable contact parts such as protection fuses and/or electric circuit isolators and the like.

With the terminal blocks of the conventional type it is necessary, however, to provide a specific and dedicated terminal block for each type of movable contact with an obvious increase in the production and warehouse management costs.

SUMMARY

The technical problem which is posed, therefore, is to provide a universal fuse-holder terminal block, in particular of the type for wired-circuit switchboards, which allows the possibility of being able to insert indifferently any type of movable contact such as isolating fuses or the like, without having to replace the terminal block when there is a variation in the type of contact to be inserted.

In connection with this problem it is also required that this terminal block should consist of a small number of component parts which can be produced and assembled easily and at a low cost.

These results are achieved according to the present invention by a terminal block for connecting electric wires by means of a movable flat-pin contact, which comprises an insulating body and two conducting parts housed inside it and associated with respective means for retaining the free end of a respective electric wire, the conducting part having an end opposite to the wire retaining end formed in the manner of a resilient clamp which is open on one side for insertion, retention and electric contact with the respective flat pin of the movable contact.

BRIEF DESCRIPTION OF THE FIGURES

Further details may be obtained from the following description of a non-limiting example of embodiment of the subject of the present invention provided with reference to the accompanying drawings, in which:

FIGS. 4*a*, 4*b* show perspective views of the terminal block according to the invention with the fuse extracted/inserted, respectively;

FIG. 5 is a cross-section similar to that of FIG. 2 with a line isolator of the rotating type mounted;

FIGS. 6*a*,6*b* are perspective views of the terminal block according to FIG. 5 with the rotating isolator extracted/inserted, respectively.

DETAILED DESCRIPTION

Figure 1:
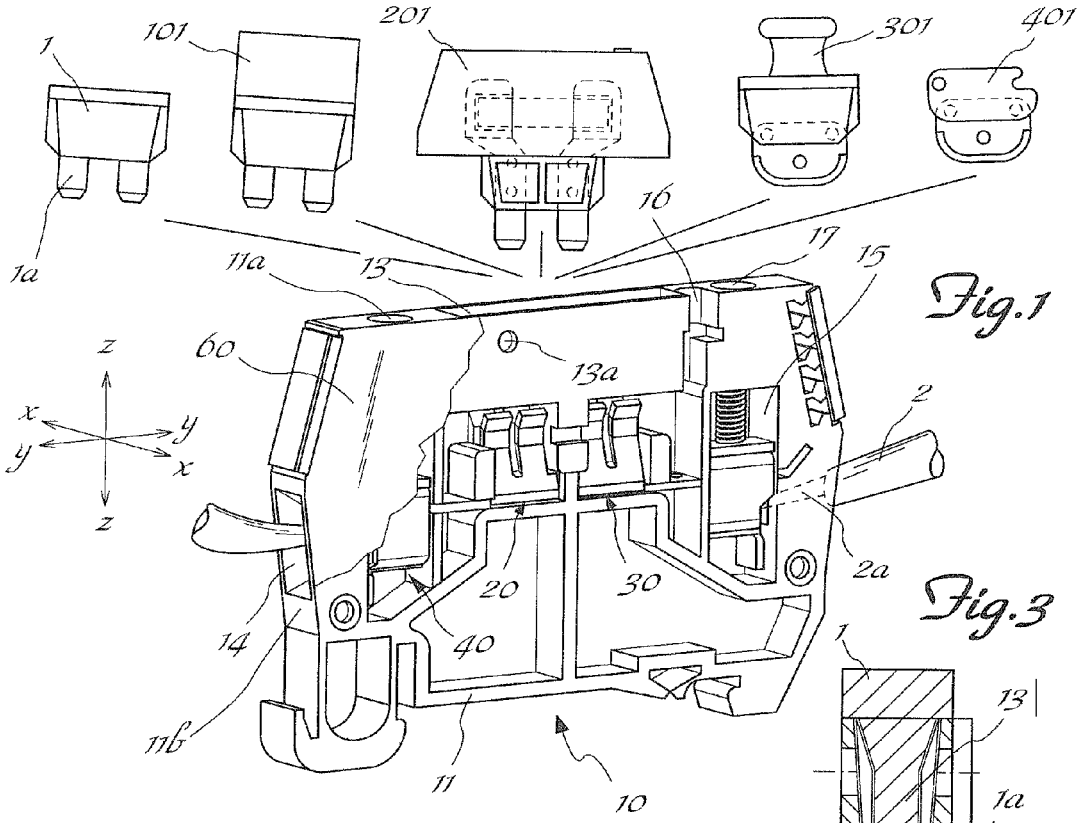
FIG. 1 shows a perspective view of one embodiment of the terminal block according to the present invention.

As shown in FIG. 1, and assuming solely for the sake of convenience of the description and without a restrictive meaning, a set of three reference axes in a longitudinal direction X-X, transverse direction Y-Y and vertical direction Z-Z, respectively, which conveniently coincide with the axis of symmetry, the terminal block according to the present invention comprises an insulating body 10 forming the container of the conducting part 20 with which the terminal 40 for retaining the free end 2*a* of the electric wire 2 and the receptacle 30 for connection to the fuse 1 of the type with flat pin 1*a* are associated.

In greater detail, the insulating body 10 has a substantially closed-loop frame 11 formed so as to define at least one front side 11*a* and at least two respective sides 11*b* situated opposite each other.

The body 10 has formed internally:

- a first pair of seats 12 which are open in the transverse direction Y-Y and symmetrical with respect to the vertical direction Z-Z;
- a second pair of seats 15 which are respectively arranged on the opposite sides to the seats 12 towards the flanks 11*b* and are in turn symmetrical with respect to the axis Z-Z;

The front side 11*a* of the frame 11 also has, formed therein:

- a first opening 13 extending in the vertical and longitudinal direction and arranged substantially above the seats 12 and able to connect said seats with the exterior;
- holes 17 with a vertical axis Z-Z respectively aligned with said second seats 15 and able to connect the latter with the exterior.

Each side 11*b* of the frame 11 has a respective opening 14 for introducing the wire 2 in the longitudinal direction X-X.

The conducting part 20 which, during use, connects each wire 2 to the respective flat pin 1*a* of the fuse 1, is formed by means of a base plate 21 which extends in the longitudinal direction X-X towards the outside so as to form a free end with a tip 22 which is inclined upwards and designed to engage with a corresponding internal seat 18 provided on each side 11*b* of the frame 11, so as to ensure the stable retention of the conducting part 20 within the insulating body 10.

Figure 2:
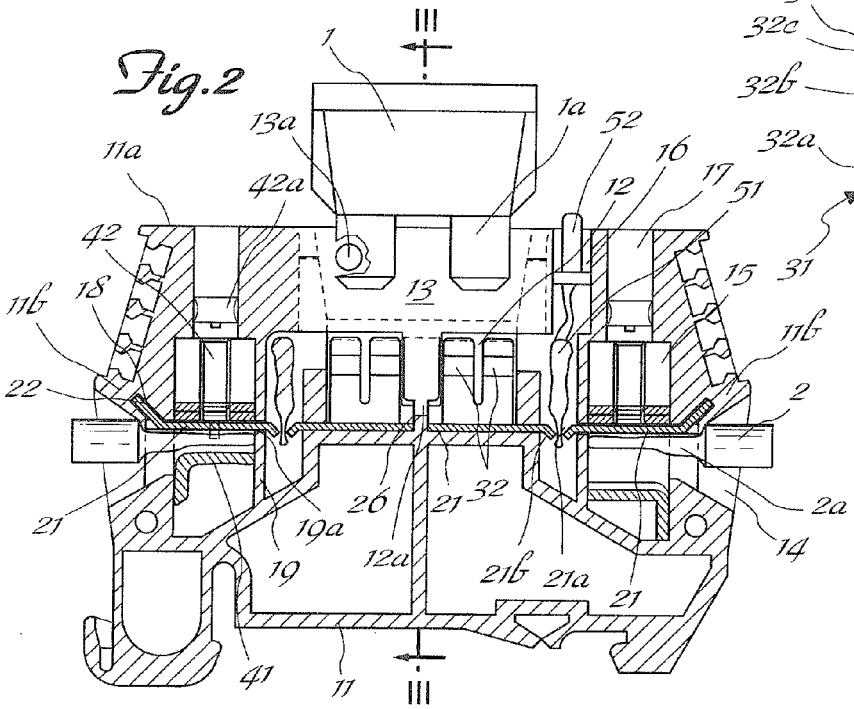
FIG. 2 shows a schematic cross-section along a vertical longitudinal plane of the terminal block according to FIG. 1 assembled with a fuse.
Figure 3:
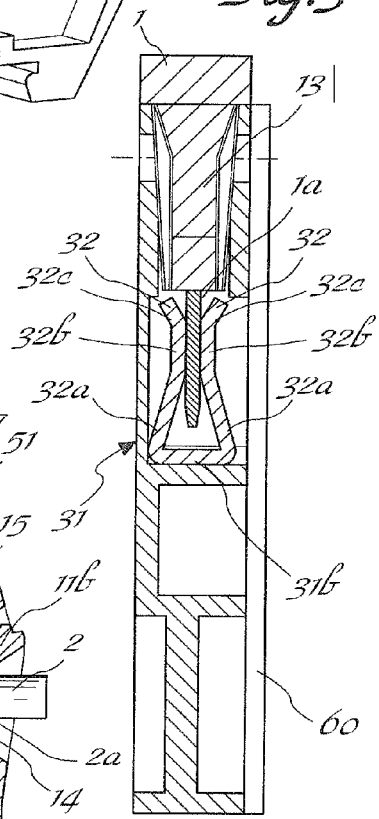
FIG. 3 shows a cross-section along the plane indicated by the line III-III of FIG. 2.

In the example according to FIGS. 1-3, the terminal 40 for retaining the electric wire 2 includes the wire clamp 41 with an actuating screw 42; the head 42*a* of said screw 42 is accessible from the outside via the said hole 17 with a vertical axis Z-Z inside which it is possible to insert the operating implement for turning the screw, the end of which, reacting against the surface of the base plate 21, recalls the clamp 41 which grips the end 2*a* of the wire 2 between terminal and plate.

The conducting part 20 is completed by the receptacle 30 for retaining the flat pin 1*a* of the fuse 1, which are arranged in the said seat 12 of the body 10 and consist of a plate folded in the manner of a resilient clamp 31 able to grip the flat pin 1*a* of the fuse 1.

In greater detail (FIG. 3) said clamp 31 has a substantially horizontal side 31*b* forming part of the base plate 21 and two jaws 32 open towards the said front seat 13 and formed by a first section 32*a*, forming an acute angle with the base 31*b*, a second section 32*b* substantially perpendicular to the base 31*b* and a third section 32*c* forming an obtuse angle with the base 31*b*.

In this way the outermost and diverging opposite sections 32*c* allow the centring and easy and safe introduction of the flat pin 1*a* inside the clamp 31; the middle and parallel sections 32*b* produce a reliable electric contact, ensuring also the necessary conducting area for allowing a large amount of current to pass through, also in the case of a plate with a small thickness used to achieve the necessary gripping resilience; the converging sections 32*a* ensure the necessary gripping force of the jaws 32 for the said electric contact.

According to one embodiment, the jaws 32 are duplicated in the longitudinal direction X-X in order to ensure correct electrical contact also in the case of unevenness of the flat pin 1*a* of the fuse.

At its end opposite to the raised tip 22, the base plate 21 has a tooth 26 extending longitudinally beyond the clamp and able to be inserted inside a corresponding undercut 12*a* of the seat 12 so as to create an obstacle to the movement of the clamp 31 in the vertical direction when the fuse 1 is extracted.

In accordance with an embodiment of the invention, the said seats 12 and 15 are separated from each other by an insulating partition 19 extending in the vertical direction Z-Z and having a longitudinal through-opening 19*a* designed to allow the insertion of the said base plate 21 in the transverse direction Y-Y.

In a position substantially adjacent to the partition 19 and inside the seat 12, the plate 21 has an opening 21*a* defined by two inclined tongues 21*b* which are suitably calibrated and able to allow the insertion, but not the extraction, of the control circuits 51 for indicating correct operation of the terminal block; said circuits 51 are in turn connected to a luminous signalling component 52 arranged in a respective seat 16 in the front side 11*b* of the body of the terminal block so as to be visible from the exterior.

In a preferred embodiment said signalling component consists of an LED.

As can be seen, the control circuits 51 are housed in a compartment of the seat 16 so as to be arranged on the side of the base plate directed towards the front opening 13, thus avoiding the need for conductors to pass through the latter.

As shown in FIGS. 2 and 3, during use:

the terminal block 10 is assembled by removing the front cover 60, inserting the conducting part 20 in the transverse direction Y-Y so that the receptacle 30 for engagement with the fuse 1, the terminals 40 for retaining the wire 2, and the tip 22 of the base plate 21 are arranged inside the respective seats 12,15,18;

the cover 60 is closed;

the wires 2 are inserted inside the respective entry seats 14;

the head of the screw 42*a* is operated so as to tighten the clamps 41;

the fuse 1 is inserted inside the seat 13 so that the flat pins 1*a* engage fully between the resilient jaws 32 of the clamp 31;

the LED 52 is checked to ensure that it indicates correct operation.

As shown in FIGS. 2, 5, 6*a* and 6*b*, the open front seat 13 has a pair of holes 13*a* which are formed in the opposite vertical walls of the said seat and are able to receive corresponding transverse pins 401*a* of single-pin isolators 401 of the type which can be inserted/removed by means of rotation instead of by displacement.

Figure 7A:
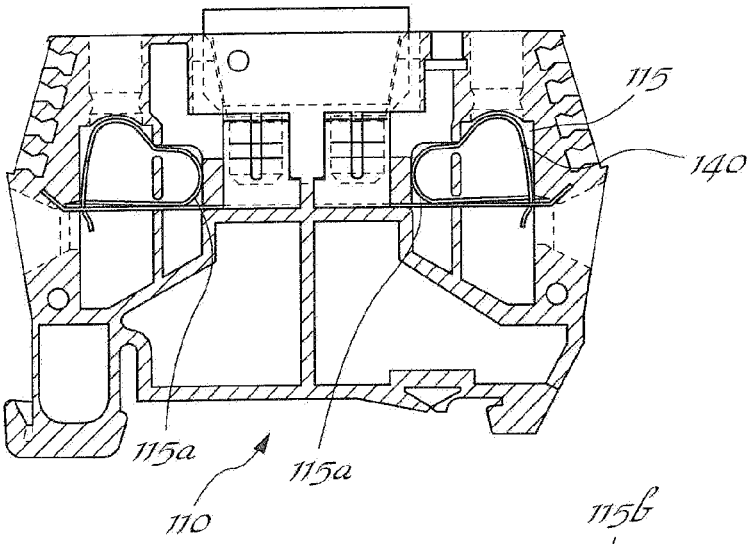
FIGS. 7*a*,7*b*,7*c* is a schematic cross-section along a vertical longitudinal plane of a further embodiment of the terminal block according to the present invention with a spring-type, screw-type and mixed gripping part.
Figure 7B:
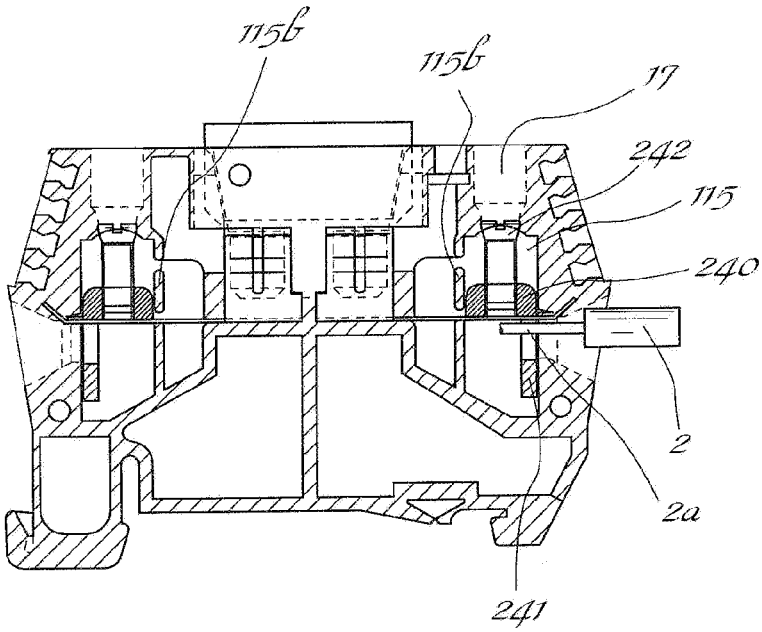

As shown in FIG. 7*a*, the insulating body 110 has second seats 115 with a substantially L-shaped aperture having a horizontal arm 115*a* extending towards the axis of symmetry Z-Z.

With this form of the seat 115, the latter is able to contain a terminal for retaining the wire 2, which are designed both as a resilient plate 140 (FIG. 7*a*) and as a terminal clamp 240 with a gripping conducting part 241 in the form of an overturned L which can be operated by means of a screw 242 which can be accessed via the hole 17; this gripping part in the form of an overturned "L" is also described in the patent application IT M12007A 1390 in the name of the same present applicant.

The inside of each seat 115 is also provided with a vertical projection 115*b* for centering the terminals 140,240 for retaining the wire 2.

Figure 7C:
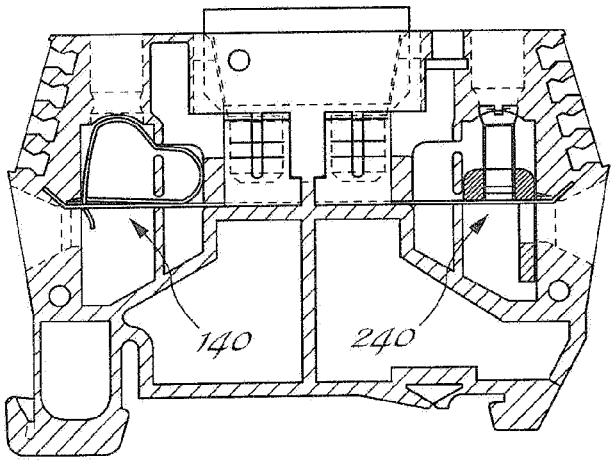

FIG. 7*c* also shows a mixed configuration of the terminal block with one of the two parts for gripping the wire 2 designed as a resilient plate 140 and the other as an overturned L piece 240.

It is therefore clear how the fuse-holder terminal block according to the invention is suitable for combination with any type of movable contact 101,201,301,401 of the flat-pin type shown in FIG. 1 and is able to ensure an electrical contact between the pins of the fuse and the conducting part of the terminal block which is very precise, reliable and has a high conducting capacity; moreover, the particular symmetrical form of the internal conducting part allows a reduction in the number of parts which must manufactured and stocked since the same part may be equally well used for right-hand or left-hand mounting by means of sole positioning inside the insulating body of the terminal block.

With the configuration of the body of the terminal block according to FIG. 7*a*, in addition to being able to configure the fuse holder for varying operational requirements, it is also possible to use the insulating body with the different types of wire gripping components, thereby ensuring more cost-effective management of the various component parts and the whole assembly.

The invention claimed is:

1. A terminal block for connecting electric wires by means of a movable contact having flat pins, the terminal block comprising:

an insulating body and two conducting parts housed inside the body;

each conducting part including, adjacent a first end of the conducting part, a wire retaining element for retaining a free end of an electric wire and, at an opposite end, a resilient clamp adapted for insertion, retention and making electrical contact with a flat pin of the movable contact; and each resilient clamp including a set of jaws independent from one another along the transversal direction, each set of jaws being adapted for insertion, retention and making electrical contact with a portion of the flat pin of the movable contact, wherein each conducting part comprises a base plate extending in the longitudinal direction to a first end, towards an outer side of the insulating body, and said resilient clamp is integral with said base plate at the opposite end, and wherein said first end is inclined upwards and an adapted to engage a corresponding internal seat in the insulating body to hold the base plate.

2. A terminal block according to claim 1, wherein said resilient clamp includes a folded plate and adapted to resiliently grip the flat pin of the moveable contact.

3. A terminal block according to claim 2, wherein said folded plate has a substantially horizontal side forming part of the base plate and two open jaws, each jaw including a first section forming an acute angle with the base plate, a second section substantially perpendicular to the base plate and a third section forming an obtuse angle with the base plate.

4. A terminal block according to claim 2, wherein the resilient clamp includes two or more folded plates.

5. A terminal block according to claim 1, wherein the insulating body has a frame forming a substantially closed loop and defining at least one front end and at least two opposite sides.

6. A terminal block according to claim 1, wherein the base plate includes a tooth extending in the longitudinal direction from the opposite end.

7. A terminal block according to claim 1, wherein the said insulating body includes a first pair of seats, each seat being open in a transverse direction and symmetrical with respect to the vertical direction and adapted to contain a resilient clamp.

8. A terminal block according to claim 7, wherein said seat has an undercut designed to interfere with said longitudinal tooth of the base plate.

9. A terminal block according to claim 7, wherein said insulating body includes a second pair of seats disposed on opposite sides to the first pair of seats and symmetrical with respect to a vertical axis of the insulating body, the second pair of seats are adapted for receiving wires to be retained by one of the wire retaining elements.

10. A terminal block according to claim 9, wherein the second pair of seats includes an L-shaped element with a horizontal arm extending towards a vertical axis of symmetry of the insulating body.

11. A terminal block according to claim 9, wherein the insulating body includes a vertical projection adapted for centering and guiding the wire retaining elements.

12. A terminal block according to claim 1, wherein the insulating body includes a plurality of openings adapted for receiving the wire in the longitudinal direction.

13. A terminal block according to claim 1, wherein the insulating body includes a frame having a front end and the front end includes a first opening extending in the vertical direction and providing access to the resilient clamps inside the frame.

14. A terminal block according to claim 9, wherein the front end of the frame includes a hole extending in a vertical direction and providing access to the wire retaining elements.

15. A terminal block according to claim 1, wherein the insulating body further comprises an insulating partition extending in the vertical direction and separating the wire retaining elements from the resilient clamps, said partition having a longitudinal opening for insertion of the conducting part in the transverse direction.

16. A terminal block according to claim 1, wherein the wire retaining elements include a terminal and an actuating screw.

17. A terminal block according to claim 16, wherein the terminal of at least one wire retaining element is in the form of an overturned L.

18. A terminal block according to claim 1, wherein the wire retaining elements includes a spring.

19. A terminal block according to claim 1, wherein the insulating body further comprises a luminous signaling component and an open seat for housing the luminous signalling component in a position where the luminous signaling component is visible from the outside the insulating body, the luminous signaling component being connected to a control circuits for monitoring an operation of the terminal block.

20. A terminal block according to claim 19, wherein the luminous signaling component includes an LED.

21. A terminal block according to claim 19, wherein the open seat has a compartment for housing the control circuits.

22. A terminal block according to claim 19, wherein the control circuits are arranged on one side of the conducting part directed towards the front opening for housing the movable contact part.

23. A terminal block for connecting electric wires by means of a movable contact having flat pins, the terminal block comprising:

an insulating body and two conducting parts housed inside the body;

each conducting part including, adjacent a first end of the conducting part, a wire retaining element for retaining a free end of an electric wire and, at an opposite end, a resilient clamp adapted for insertion, retention and making electrical contact with a flat pin of the movable contact; and each resilient clamp including a set of jaws independent from one another along the transversal direction, each set of jaws being adapted for insertion, retention and making electrical contact with a portion of the flat pin of the movable contact, wherein each conducting part comprises a base plate extending in the longitudinal direction to a first end, towards an outer side of the insulating body, and said resilient clamp is integral with said base plate at the opposite end, and wherein at least one base plate includes an opening, defined by two inclined tongues, and adapted to allow the insertion, in one direction, of a terminal block control component.

* * * * *